US009121575B2

(12) United States Patent
Quadri et al.

(10) Patent No.: US 9,121,575 B2
(45) Date of Patent: Sep. 1, 2015

(54) STAGE LIGHT FIXTURE

(71) Applicant: CLAY PAKY S.p.A., Seriate (IT)

(72) Inventors: Pasquale Quadri, Torre De' Roveri (IT); Angelo Cavenati, Brusaporto (IT)

(73) Assignee: CLAY PAKY S.P.A., Seriate (IT)

( * ) Notice: Subject to any disclaimer, the term of this patent is extended or adjusted under 35 U.S.C. 154(b) by 35 days.

(21) Appl. No.: 14/056,601

(22) Filed: Oct. 17, 2013

(65) Prior Publication Data

US 2014/0111999 A1 Apr. 24, 2014

(30) Foreign Application Priority Data

Oct. 18, 2012 (IT) ..... MI2012A001769

(51) Int. Cl.
*F21V 9/08* (2006.01)
*F21S 10/00* (2006.01)
*F21W 131/406* (2006.01)

(52) U.S. Cl.
CPC ..... *F21V 9/08* (2013.01); *F21S 10/007* (2013.01); *F21W 2131/406* (2013.01)

(58) Field of Classification Search
CPC ..... F21S 10/007; F21V 14/08
USPC ..... 362/293
See application file for complete search history.

(56) References Cited

U.S. PATENT DOCUMENTS

| | | | | |
|---|---|---|---|---|
| 5,029,992 | A * | 7/1991 | Richardson | 359/696 |
| 6,113,252 | A * | 9/2000 | Arlitt et al. | 362/365 |
| 2006/0007686 | A1 * | 1/2006 | Hough | 362/293 |
| 2008/0062684 | A1 | 3/2008 | Belliveau et al. | |

FOREIGN PATENT DOCUMENTS

| | | |
|---|---|---|
| EP | 1 158 239 | 11/2001 |

* cited by examiner

*Primary Examiner* — Mary Ellen Bowman
(74) *Attorney, Agent, or Firm* — Leason Ellis LLP

(57) ABSTRACT

A stage light fixture is provided with a light source adapted to emit a light beam along an optical axis, and a color filter assembly comprising a plurality of color filters rotating about a same first axis of rotation, the first axis of rotation being parallel to the optical axis and not coincident with the optical axis.

12 Claims, 7 Drawing Sheets

STAGE LIGHT FIXTURE

The present invention relates to a stage light fixture.

CROSS-REFERENCE TO RELATED APPLICATION

The present application claims priority to Italian Patent Application No. MI2012A 001769, filed Oct. 18, 2012, which is hereby incorporated by reference in its entirety.

BACKGROUND OF THE INVENTION

Known stage light fixtures comprise a casing having a first closed end and a second open end; a light source arranged within the casing in the proximity of the first closed end and adapted to emit a light beam along an optical axis; and a lens arranged at the open end so as to intercept the light beam.

The stage light fixtures of this type are also provided with beam processing means adapted to change the projected light beam and generate special scenic effects. In particular, the light beam processing means comprise a plurality of color filters of different colors, which are substantially band-pass filters with high selectivity and able to color the input beam.

The light beam processing means also comprise a dimmer, which comprises a filter configured to reduce the brightness of the light beam that passes therethrough.

The latest generation stage light fixtures are characterized by very reduced dimensions and, therefore, the space available for the handling of the filters is minimal.

In stage light fixtures of this type happens that the simultaneous use of color filters and dimmer determines the onset of obvious defects in the light beam.

SUMMARY OF THE INVENTION

It is therefore an object of the present invention to provide a stage light fixture free from the drawbacks of the known art here highlighted; in particular, it is an object of the invention to provide a stage light fixture that allows to overcome the drawbacks highlighted above in a simple and economic way, both from the functional point of view, and from the constructive point of view.

In accordance with said objects, the present invention relates to a stage light fixture according to claim 1.

BRIEF DESCRIPTION OF THE DRAWINGS

Further characteristics and advantages of the present invention will become clear from the following description of one of its non-limiting examples of embodiment, with reference to the accompanying drawings, wherein.

DETAILED DESCRIPTION OF THE INVENTION

Figure 1:
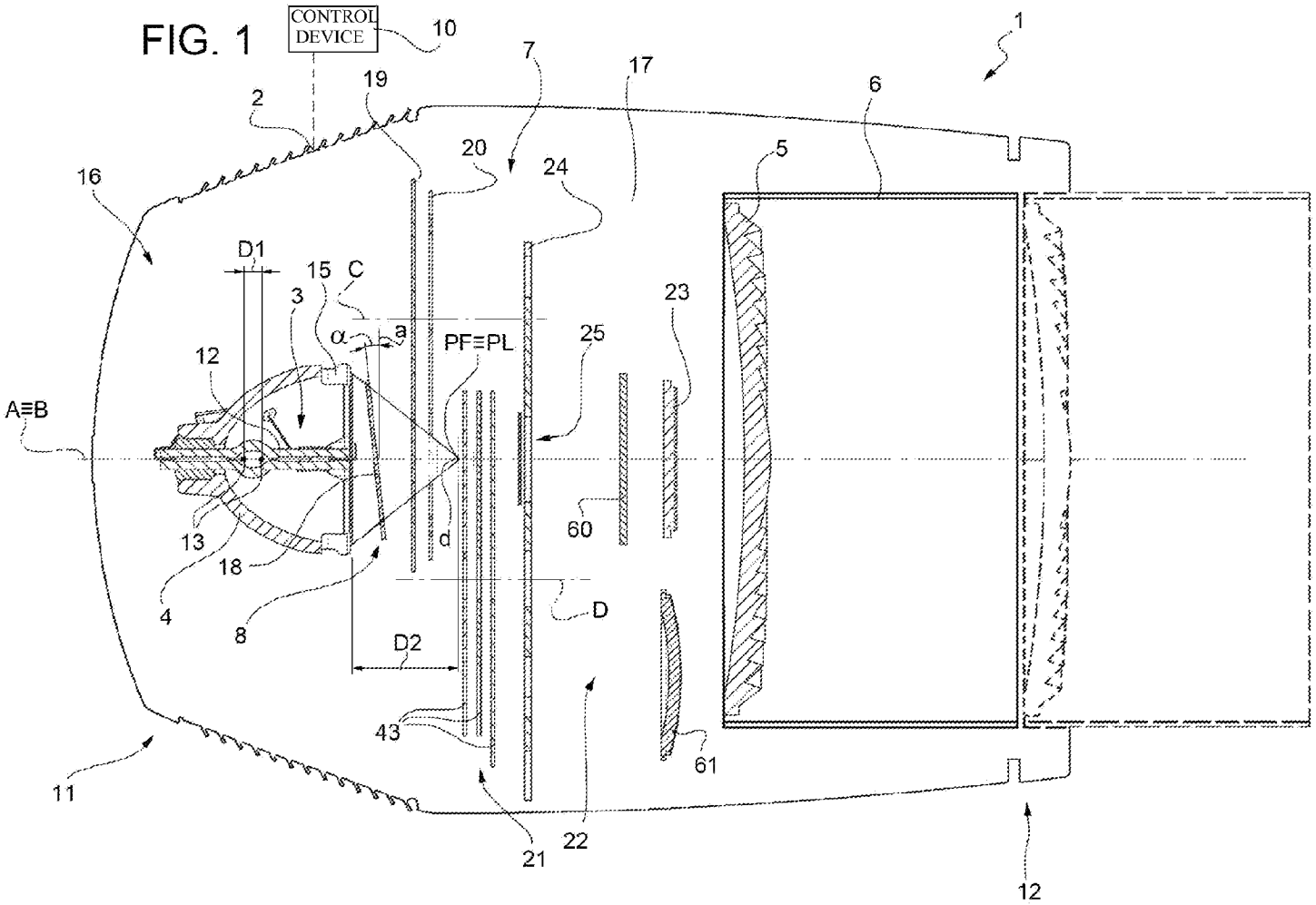
FIG. 1 is a schematic side view, with parts in section and parts removed for clarity, of a stage light fixture according to the present invention.

In FIG. 1 is indicated with the reference number 1 a stage light fixture comprising a casing 2, a light source 3, a reflector 4, a final lens 5, beam processing means 7 (shown schematically in FIG. 1), an anti-heat assembly 8 (shown schematically in FIG. 1), and a control device 10.

The casing 2 extends along a longitudinal axis A and has a closed end 11 and an open end 12 opposite the closed end 11 along the axis A. Preferably, the casing 2 is supported by support means (not shown for simplicity in the attached figures). In particular, the support means and the casing 2 are configured to allow the casing 2 to rotate about two orthogonal axes, commonly called PAN and TILT axis.

Preferably, the stage light fixture 1 comprises a skeleton (not shown for simplicity in the attached figures) consisting of elements coupled together and configured to define a support structure for the elements arranged inside the casing 2, such as the light source 3, the reflector 4, the light beam processing means 7 and the anti-heat assembly 8.

The light source 3 is arranged within the casing 2 at the closed end 11 of the casing 2, is supported by the skeleton, and is adapted to emit a light beam substantially along an optical axis B.

In the non-limiting example described and illustrated here, the optical axis B coincides with the longitudinal axis A of the casing 2.

The light source 3 is a short arc lamp, in the technical jargon commonly called "short arc lamp".

In particular, the short arc lamp 3 comprises a bulb 13, generally in glass or quartz, containing halides.

Inside the bulb 13 two electrodes 14 are arranged connected to a power supply circuit (not visible in the attached figures) and arranged at a distance D1 one from the other.

The distance D1 between the electrodes 14 is less than about 2 mm. In the non-limiting example described and illustrated here the distance D1 is approximately 1 mm.

In the non-limiting example described and illustrated here the short arc lamp 3 has a power of about 330 watts.

For example, the lamp 3 is an OSRAM lamp model SIRIUS HRI 330.

The reflector 4 is a preferably elliptical reflector, is coupled to the light source 3 and is provided with an outer edge 15.

In particular, the reflector 4 and the light source 3 are configured and coupled together so as to concentrate the rays of the light beam substantially in a work point PL arranged at a distance D2 from the outer edge 14 of the reflector 4.

In the non-limiting example described and illustrated here the distance D2 is equal to approximately 31 mm.

In substance, the reflector 4 and the light source 3 are configured and coupled together so as to emit a very intense light beam focused at the work point PL.

In particular, the rays of the light beam generate at the work point PL a very concentrated beam having a diameter d less than one millimeter. Preferably, at the work point PL the light beam has a diameter d of 0.8 mm.

The light beam is, therefore, very concentrated and intense at the work point PL. This allows to obtain a very bright output beam from the stage light fixture.

The final lens 5 is arranged at the open end 12 of the casing 2 so as to be centered on the optical axis B and to close the casing 2.

The final lens 5 has a focal point PF arranged between the light source 3 and the optical assembly 5.

Preferably, the focus point PF coincides with the work point PL. In this way, the final lens 5 exploits the maximum intensity of the light beam and gives rise to a very intense and concentrated light beam.

In the non-limiting example described and illustrated here, the final lens is a Fresnel lens. The beam generated by this lens is therefore a diffused beam.

A variant not shown provides that the final lens 5 is a Fresnel lens wherein the annular segments are shaped as a spiral instead as a ring as in most of the Fresnel lenses.

A variant not shown provides that the final lens 5 is an objective lens, preferably an optical zoom assembly.

Preferably, the lens 5 is movable along the optical axis B between a first operating position and a second operating position (represented with dashed lines in FIG. 1). The lens 5 is preferably coupled to a carriage movable along the optical axis B (not shown for simplicity).

The stage light fixture 1 also comprises a lens hood 6, which has a cylindrical wall with a circular section about the optical axis B and is connected to the lens 5 so that the lens 5 maintains unchanged its position with respect to the lens hood 6 in any operating position of the lens 5. In other words, the lens hood 6 is fixed to the lens 5. An example of said solution is described in patent application M12005A000164 in the name of the same applicant.

The anti-heat assembly 8 is substantially configured so as to generate a thermal barrier between the area 16 wherein the light source 3 is housed and the area 17 wherein the light beam processing means 7 are housed.

The anti-heat assembly 8 comprises an anti-heat filter 18 and a frame (not shown in the attached figures) coupled to the skeleton and configured to support the anti-heat filter 18.

The anti-heat filter 18 is configured to filter the heat radiation (radiation which involves an increase in temperature of the body which is affected) in the field of non-visible radiation coming from the area where the light source 3 is. In this way the heat radiation in the field of non-visible radiation generated by the light source 3 and by the reflector 4 is prevented from affecting the overall light beam processing means 7.

Preferably, the anti-heat filter 18 is arranged transverse to the optical axis B. In the non-limiting example described and illustrated here the filter 18 forms an angle $\alpha$, with a plane perpendicular to the optical axis B. The angle $\alpha$ is a dihedral angle preferably comprised between 5° and 8°. In the non-limiting example described and illustrated here the angle $\alpha$ is equal to 6°. The inclination of the anti-heat filter 18 prevents overheating of the light source, since the rays reflected from the anti-heat filter 18 are diverted outside the reflector 4 and not within the reflector 4 where the light source 3 is housed.

The light beam processing means 7 are supported by the skeleton and are configured to process the light beam generated by the light source 3 in order to obtain special effects.

In particular, the light beam processing means 7 comprise, preferably in sequence, at least a dimmer 19, a color disc 20, a color filter assembly 21, a frost assembly 22 and a beam shaper element 23.

It is understood that the light beam processing means 7 can comprise further beam processing devices not described here.

Between the color filter assembly 21 and the frost assembly 22 a plate 24 is arranged, which is provided with an outlet mouth 25, substantially circular, centered on the optical axis B and transparent to light radiation. In use, the plate 24 cuts the portion of the beam which impacts outside the outlet mouth 25, giving rise to a beam having substantially the size of the outlet mouth 25.

Figure 2:
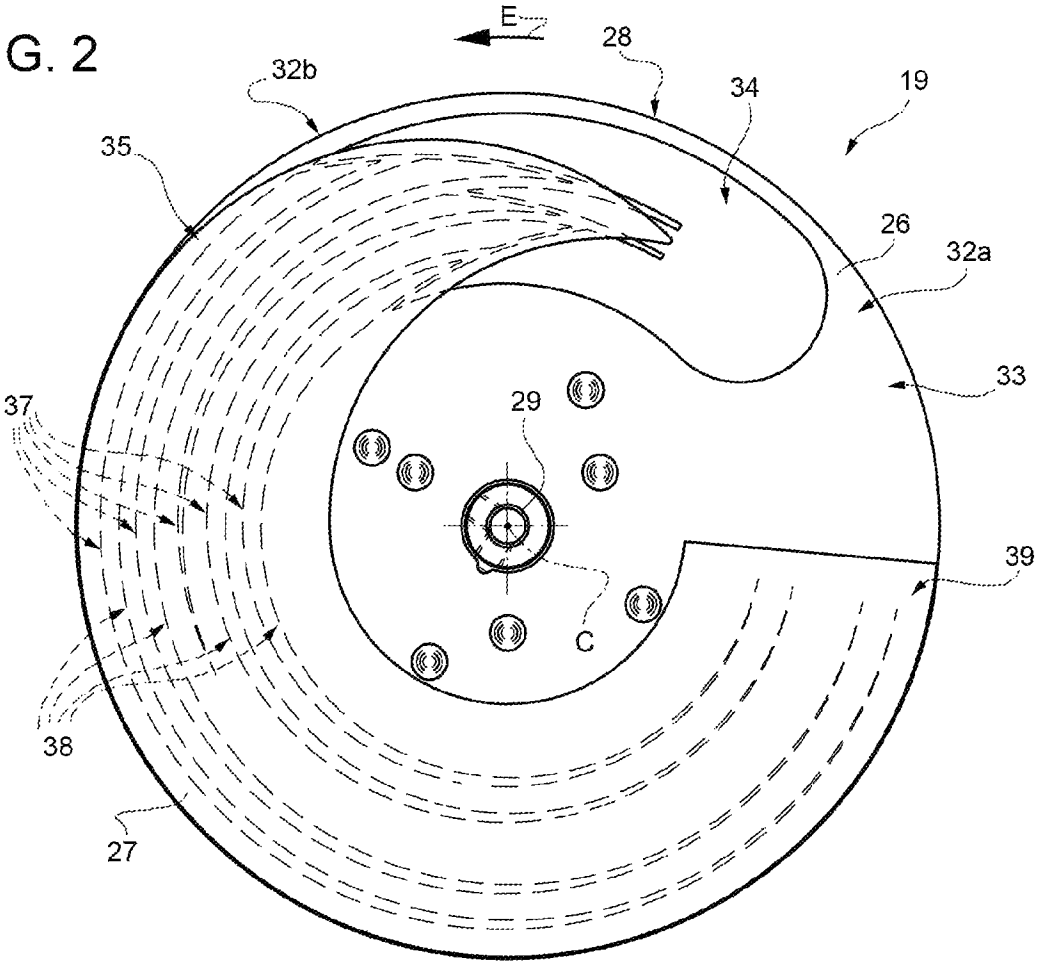
FIG. 2 is a front view, with parts removed for clarity, of a first detail of the stage light fixture of FIG. 1.

With reference to FIG. 2, the dimmer 19 comprises a dimmer filter 26 configured to reduce the brightness of the light beam that passes through it and a diffuser optical element 27 coupled to the dimmer filter 26.

In particular, the dimmer filter 26 comprises a circular plate 28, rotating about an axis of rotation C. The plate 28 is centrally fixed to a shaft 29 connected to a motor 30 (partially visible in FIG. 7).

The rotation axis C is substantially parallel to the optical axis B but does not coincide with the optical axis B.

The plate 28 comprises a peripheral portion 32*a*, which is substantially ring-shaped and is arranged in the proximity of the edge 32*b* of the plate 28. The peripheral portion 32*a* comprises an opaque region 33, a transparent region 34, contiguous to the opaque region 33, and an evanescent region 35, which extends between the transparent region 34 and the opaque region 33.

The opaque region 33 is made of a material not transparent to light radiation. Therefore, the light radiation incident upon the opaque portion 33 is not transmitted.

The transparent region 34 is defined by an opening of the plate 28 and is completely transparent to light radiation.

The evanescent region 35 is defined by a plurality of opaque zones 37 alternating with a plurality of transparent zones 38 (represented in FIG. 2 with dashed lines). The opaque zones 37 and the transparent zones 38 are substantially curved. In particular, the opaque zones 37 have an increasing area along a direction E from the transparent region 34 to the opaque region 33. While the transparent zones 38 have an area substantially decreasing along the same direction E.

The optical diffuser element 27 is coupled to a face of the plate 28. Preferably, the optical diffuser element 27 has substantially the shape of the evanescent region 35 and is fixed to the plate 28 so as to completely overlap the evanescent region 35.

The optical diffuser element 27 comprises a face coupled to the plate and an outer face 39, which has been subjected to sandblasting. In this way, the output beam from the evanescent region 35 is diffused to eliminate defects due to the material with which the opaque zones 37 are made of.

With reference to FIG. 1, the color disc 20 is defined by a plate provided with a plurality of trapezoidal sectors (not visible in the attached figures). Each trapezoidal sector is defined by a color filter. All trapezoidal sectors have a different color.

The color disc 20 is rotating about the same axis of rotation C of the dimmer 19. The rotation of the color disc 20 is, however, independent of the rotation of the dimmer 19.

A variant not shown provides that the color disc 20 is arranged between the color filter assembly 21 and the plate 24 and is rotatable about an axis not coincident with the axis of rotation C of the dimmer.

Figure 7:
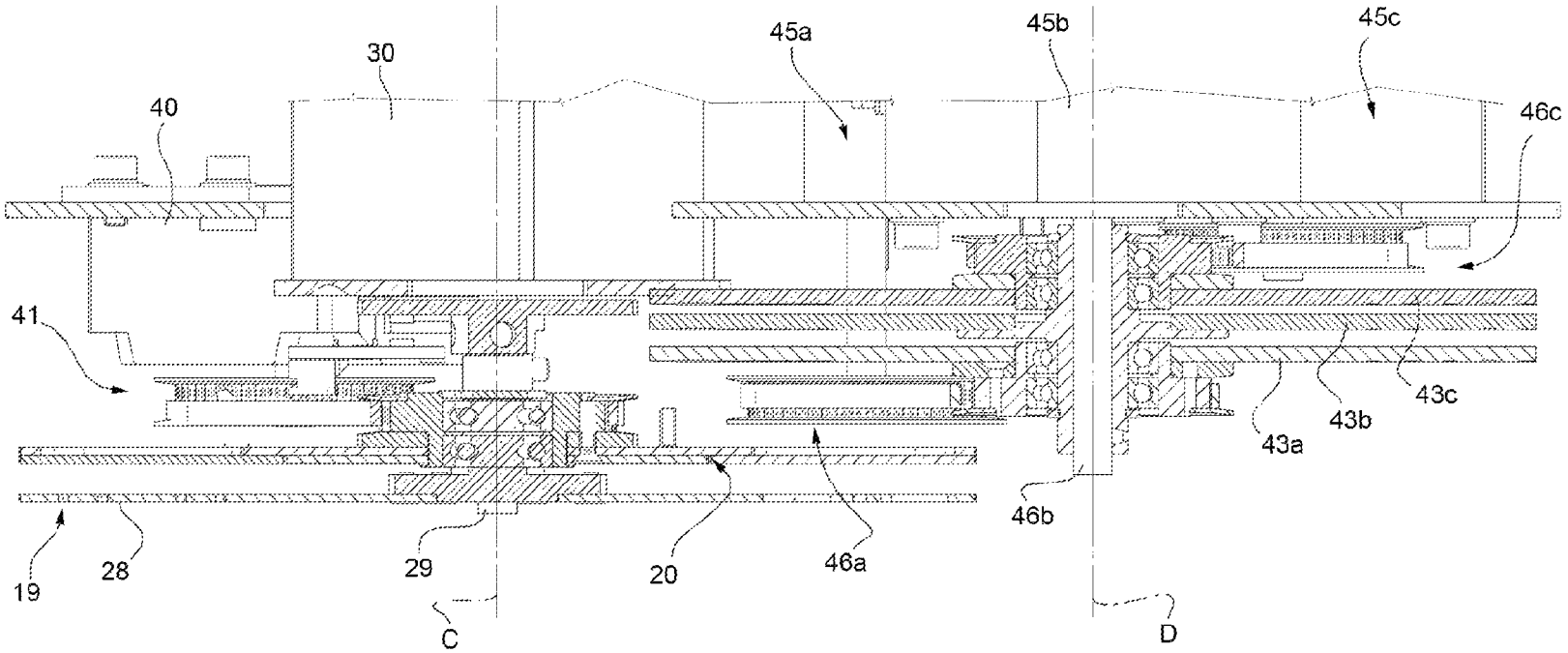
FIG. 7 is a sectional view, with parts removed for clarity, of a fourth detail of the stage light fixture of FIG. 1.

With reference to FIG. 7, the color disc 20 is coupled to a respective motor 40 by way of a belt link system 41.

With reference to FIG. 1, the color filter assembly 21 comprises at least three color filters 43*a*, 43*b* 43*c*, respectively of the colors cyan, magenta and yellow. The color filters 43 rotate about a common axis of rotation D, which is parallel to the optical axis B and does not coincide with the optical axis B nor with the axis of rotation C of the dimmer 19.

Preferably the axis of rotation D and the axis of rotation C are arranged on opposite sides of the optical axis B.

The optical axis B, the axis of rotation C and the axis of rotation D are not aligned along a plane orthogonal to the axes themselves.

In the non-limiting example the distance between the axis of rotation C and the axis of rotation B is equal to about 95 mm.

The color filters 43*a*, 43*b* 43*c* are arranged in succession along the axis of rotation D and are moved independently of each other. The adjustment of the relative position between the color filters 43*a*, 43*b* 43*c* is performed by the control device 10.

The color filters 43*a*, 43*b* 43*c* are configured to transmit light radiation having certain wavelengths and reflect light radiation having other wavelengths.

With reference to FIG. 7, the first color filter 43*a* is coupled to a respective motor 45*a* by way of a belt link system 46*a*.

The second color filter 43*b* is coupled to a shaft 46*b* moved by a respective motor 45*b*.

The third color filter 43*c* is coupled to a respective motor 45*c* by way of a belt link system 46*c*.

The choice of using belt drive systems 46*a* and 46*c* ensures that the axial dimensions of the color filters 21 is reduced.

Figure 3:
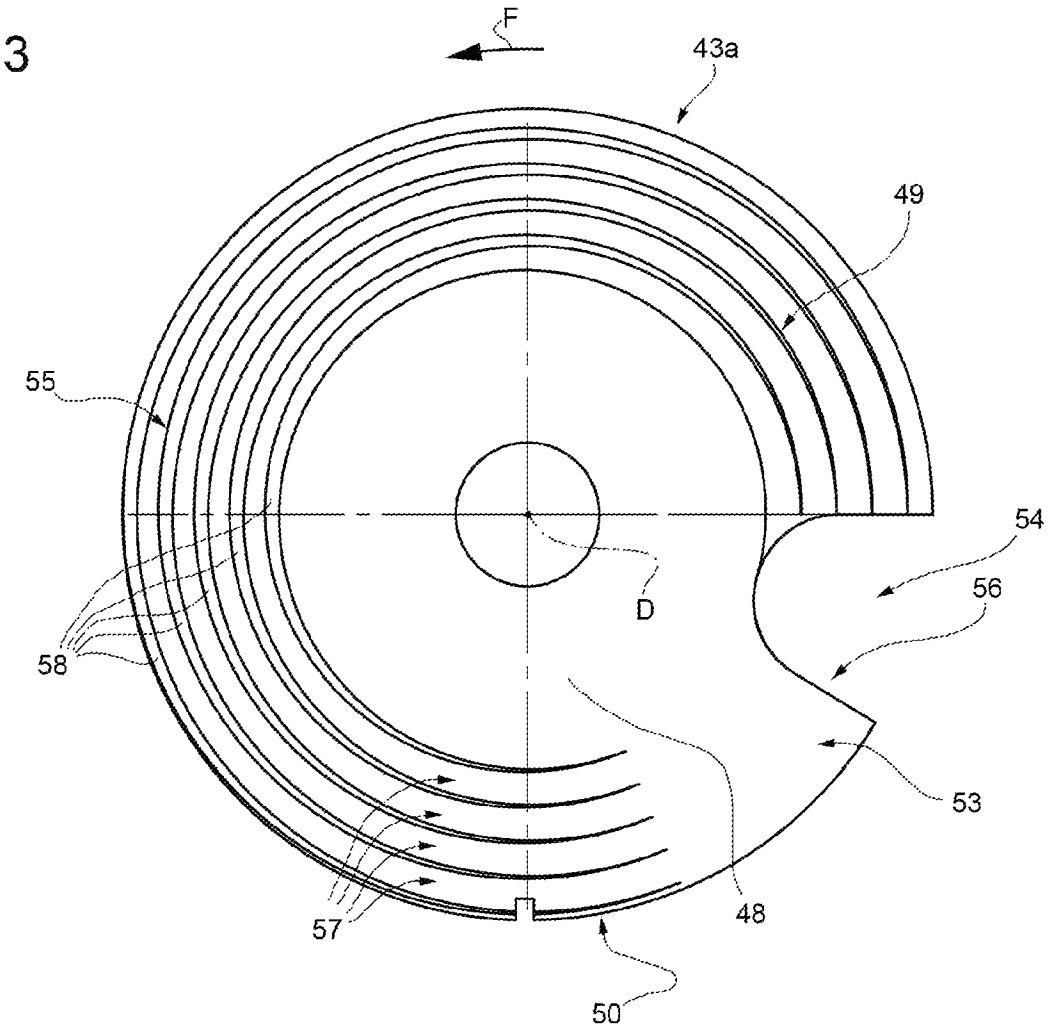
FIG. 3 is a front view, with parts removed for clarity, of a second detail of the stage light fixture according to FIG. 1.

With reference to FIG. 3, the color filters 43*a* 43*b* 43*c* are substantially identical in structure and differ substantially for the color of the filter. Therefore, in the following only the first filter 43*a* will be described. It is understood that the characteristics described for the first filter 43*a* are also present in the second filter 43*b* and in the third filter 43*c*.

The first filter 43*a* comprises a disc 48 rotatable about the axis of rotation D.

The disc 48 comprises a peripheral portion 49, which is substantially ring-shaped and is arranged in proximity to the edge 50 of the disc 48. The peripheral portion 49 comprises a colored region 53, a transparent region 54, contiguous to the colored region 53, and a colored evanescent region 55, which extends between the transparent region 54 and the colored region 53.

The colored region 53 is made of a material adapted to filter certain wavelengths (band pass filter) and reflect others so as to color the input beam.

The color imparted to the beam depends on the wavelength of the electromagnetic radiation that are not reflected by the colored region 53.

In detail, the colored region 53 is made with a material comprising a glass substrate on which a succession of layers of dielectric material is deposited.

Each color filter 43*a*, 43*b*, 43*c* differs, therefore, from the color filter 43*b*, 43*c*, 43*a* adjacent for the number and thickness of the layers of dielectric material deposited on the glass substrate in the colored region 53.

The transparent region 54 is defined by a recess 56 of the disc 48 and is completely transparent to light radiation.

The colored evanescent region 55 is defined by a plurality of colored zones 57 alternating with a plurality of transparent zones 58. The colored zones 57 and the transparent zones 58 are substantially curved. In particular, the colored zones 57 have an area increasing along a direction F from the transparent region 54 to the colored region 53. While the transparent zones 58 have an area substantially decreasing along the same direction F.

The colored zones 57 are made with the same material with which the colored region 53 is made.

Figure 4:
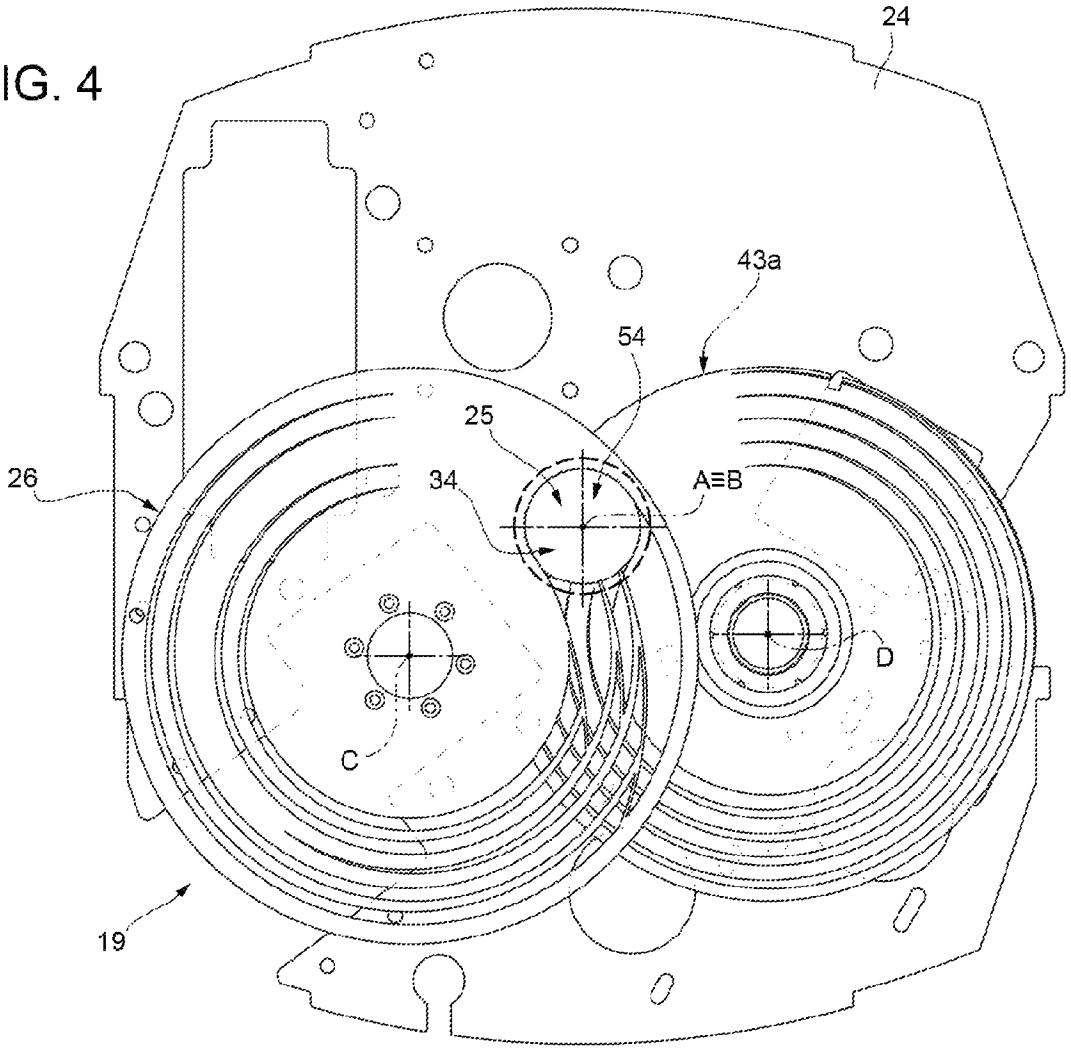
FIG. 4 is a front view, with parts removed for clarity, of a third detail of the stage light fixture of FIG. 1 in a first operating configuration.

In FIG. 4 are presented in sequence the dimmer filter 26 of the dimmer 19, the first filter 43*a* and the plate 24 provided with the outlet mouth 25.

In FIG. 4 the dimmer filter 26 is rotated so that the transparent region 34 is substantially aligned with the outlet mouth 25 while the first filter 43*a* is arranged so that the transparent region 54 is substantially aligned with the outlet mouth 25. In this configuration, the transparent region 34 and the transparent region 54 are centered on the optical axis B and the light beam generated by the light source crosses the transparent region 34, the transparent region 54 and the outlet mouth 25 without undergoing alteration.

Figure 5:
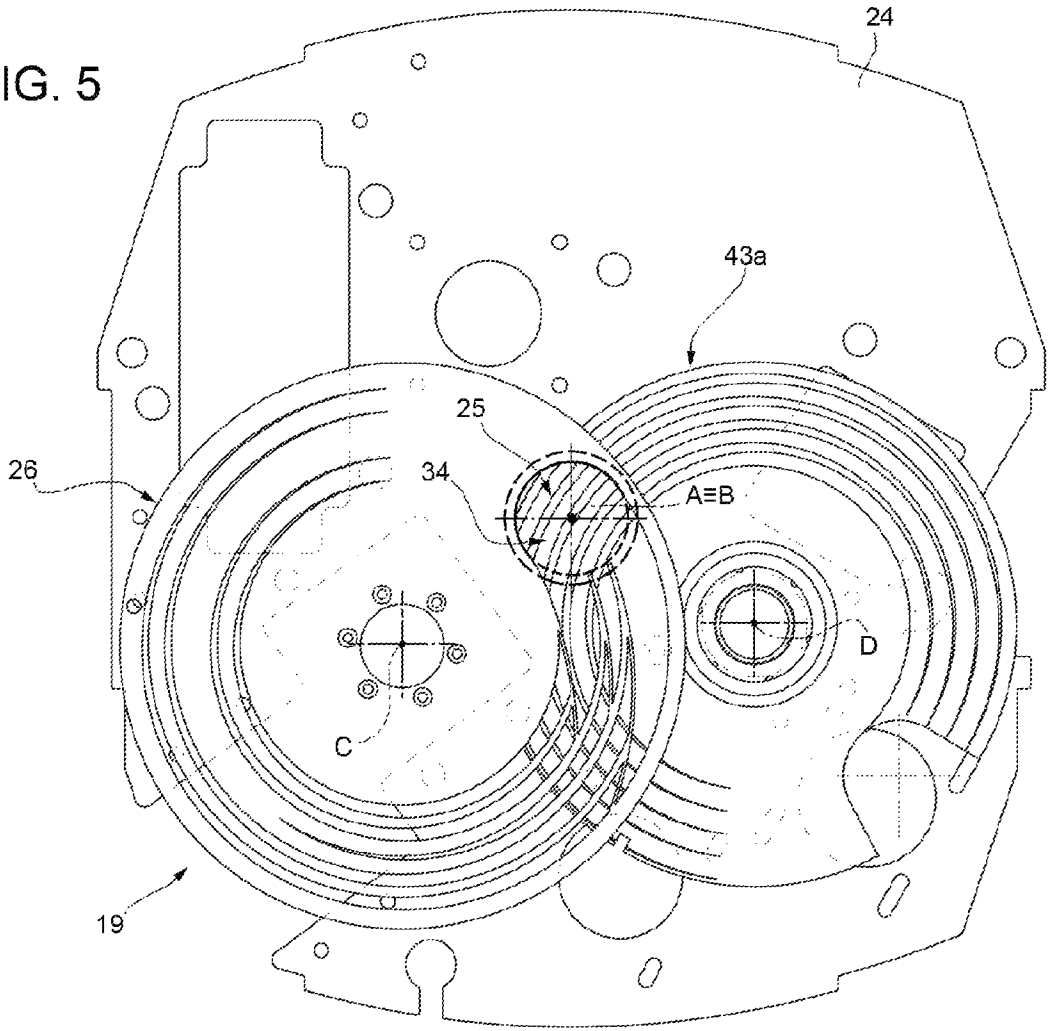
FIG. 5 is a front view, with parts removed for clarity, of a third detail of the stage light fixture of FIG. 1 in a second operating configuration.

In FIG. 5, the transparent region 34 and the outlet mouth 25 are substantially aligned and centered on the optical axis B, therefore, the intensity of the light beam is not altered.

The first filter 43*a* is instead rotated so that the colored evanescent region 55 is arranged at the outlet mouth 25. In this configuration, the light beam that comes out from the outlet mouth 25 is altered in color, having crossed the evanescent colored region 55. The intensity and the color gradation of the output beam depend on which segment of the evanescent colored region 55 is located in correspondence of the outlet mouth 25. The more the segment comes close to the colored zone 53, the more the color of the output beam is saturated.

Figure 6:
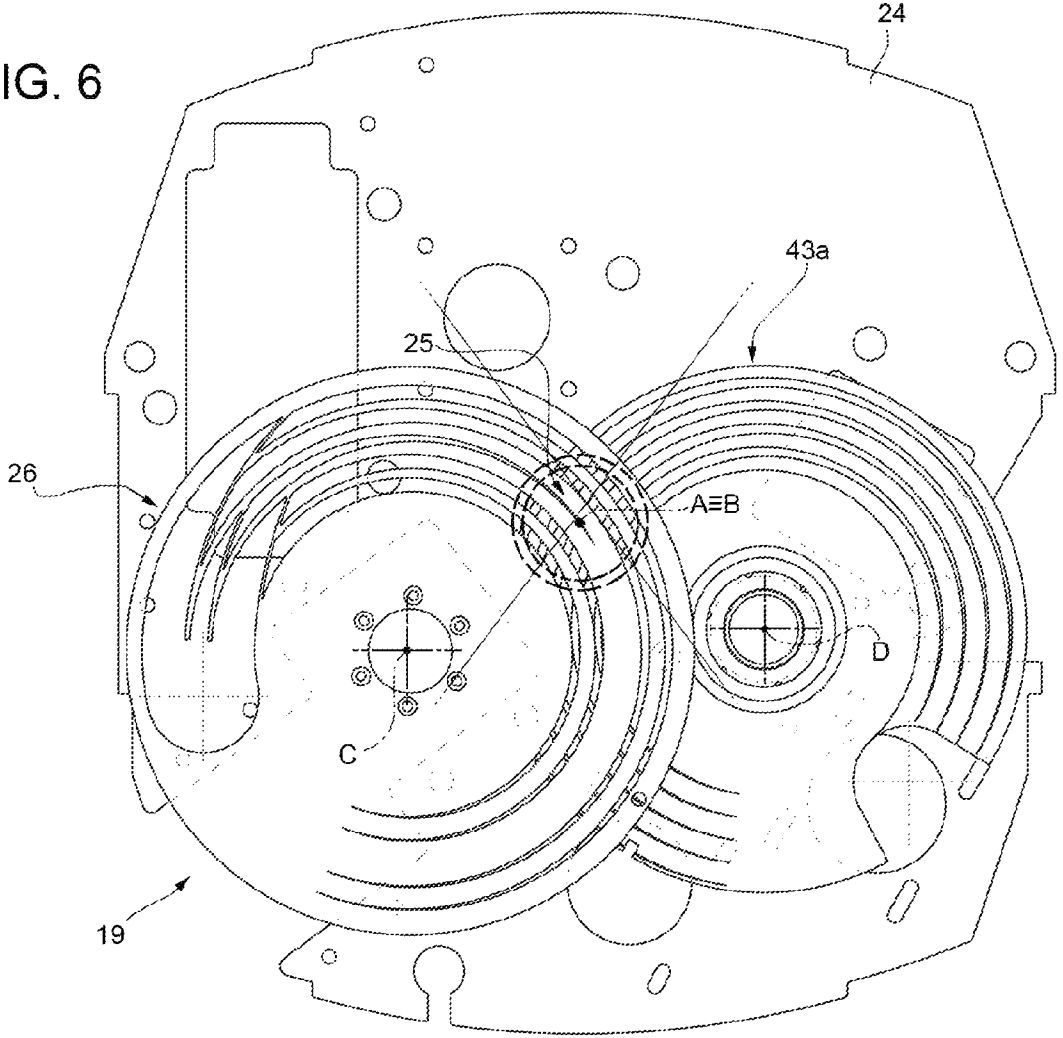
FIG. 6 is a front view, with parts removed for clarity, of a third detail of the stage light fixture of FIG. 1 in a third operating configuration.

In FIG. 6, the evanescent region 35 of the dimmer filter 26 of the dimmer 19 and the evanescent colored region 55 of the first color filter 43*a* are arranged in correspondence of the outlet mouth 25.

In this configuration, the light beam emitted from the outlet mouth 25 will be colored and will have an intensity attenuated by the dimmer 19.

In particular, the dimmer filter 26 and the first color filter 43*a* are arranged one with respect to the other so as, in a point arranged at the outlet mouth 25, the tangents of the opaque zones 37 and transparent zones 38 cross with an angle different to zero the tangents of the colored zones 57 and of the transparent zones 58.

Preferably, the angle formed by the tangents is between 60° and 90°.

In other words, the dimmer filter 26 and the first filter 43*a* are arranged one with respect to the other so that the opaque zones 37 and the transparent zones 38 cross the colored zones 57 and the transparent zones 58 avoiding a complete overlapping between the zones of the dimmer filter 26 and the zones of the color filter 43*a*.

In this way the opaque zones 37 avoid obscuring entire portions of the colored zones 57 altering the desired final effect on the light beam.

It is understood that the interaction just described between the dimmer filter 26 of the dimmer 19 and the first color filter 43*a* is also valid for the second filter 43*b* and the third filter 43*c*.

With reference to FIG. 1, the light beam processing means 7 comprise, as mentioned earlier, a frost assembly 22 and a beam shaper element 23.

The frost assembly 22 is configured to diffuse the input beam and comprises a first lens 60 and a second lens 61.

The first lens 60 and the second lens 61 can be moved so as to intercept the light beam only when necessary. The first lens 60 and the second lens 61 are in fact provided with actuating means (not visible in the attached figures) adapted to selectively arrange the first lens 60 or the second lens 61 along the optical axis B.

In use, the positioning along the optical axis B of the first lens 60 and the second lens 61 and the contemporary sliding of the final lens 5 allow to obtain a zoom of the light beam between about 6° and about 50°.

In particular, the zoom between 6° and 18° is obtained by positioning the first lens 60 along the optical axis B and by moving the final lens 5 from the final position (dashed) to the initial position.

Zooming between 18° and 50° is obtained by positioning the single second lens 61 along the optical axis B and by moving the final lens 5 from the final position (dashed) to the initial position.

The beam shaper 22 is also provided with actuating means (not shown) adapted to selectively position the beam shaper 22 along the optical axis B to intercept the light beam.

In particular, the beam shaper 22 is defined by a lens having a face shaped so that the output beam from the lens has a shape modified with respect to the shape of the input beam (generally circular). In particular, the lens of the beam shaper 22 determines an ovalization of the circular inlet light beam.

Advantageously, the stage light fixture 1 according to the present invention is adapted to generate a very powerful and concentrated light beam due to the fact that, at the work point PL, the light beam diameter is less than one millimeter.

Moreover, the fact that the final lens 5 is arranged so that its focal point PF is coincident with the work point PL ensures that all of the intensity of the beam is exploited.

The alignment of the color filters 43*a*, 43*b*, 43*c* on a single axis of rotation D allows a better distribution of the inside space of the stage light fixture 1. The further arrangement between the color filter assembly 21 and the dimmer 19 makes the stage light fixture according to the present invention particularly compact. Furthermore, the beam generated from the stage light fixture 1 when both the dimmer 19 and the color filter assembly 21 are active is free from defects and of high quality. This is because the dimmer filter 26 and the color filters 43*a* 43*b* and 43*c* are arranged one with respect to the other so that, in a point arranged at the outlet mouth 25, the tangents of the opaque zones 37 and transparent zones 38 cross with an angle different to zero the tangents of the colored zones 57 and of the transparent zones 58.

Finally, it is evident that the stage light fixture described here may be subject to modifications and variations without departing from the scope of the appended claims.

The invention claimed is:

1. Stage light fixture comprising:

a light source (3) adapted to emit a light beam along an optical axis (B);

a color filter assembly (21) comprising a plurality of color filters (43*a*, 43*b*, 43*c*) rotating about a same first axis of rotation (D); the first axis of rotation (D) being parallel to the optical axis (B) and not coincident with the optical axis (B); and at least a dimmer filter (26), rotating about a second axis of rotation (C); the first axis of rotation (D) and the second axis of rotation (C) being not coincident and parallel to the optical axis (B), wherein the dimmer filter (26) is provided with at least one evanescent region (35); the evanescent region (35) being defined by a plurality of curved opaque zones (37) interspaced by a plurality of curved first transparent zones (38); and wherein each color filter (43*a*, 43*b*, 43*c*) is provided with at least one evanescent colored region (55); the evanescent colored region (55) being defined by a plurality of curved colored zones (57) interspaced by a plurality of second curved transparent zones (58).

2. Stage light fixture according to 1, wherein the first axis of rotation (D) and the second axis of rotation (C) are arranged on opposite sides of the optical axis (B).

3. Stage light fixture according to claim 1, wherein the first axis of rotation (D) and the second axis of rotation (C) are arranged at a distance of about 95 mm.

4. Stage light fixture according to claim 1, comprising an outlet mouth (25), which is centered on the optical axis (A) and is transparent to the light radiation; the dimmer filter (26) and each color filter (43*a*, 43*b*, 43*c*) are arranged one with respect to the other so as, in a point arranged at the outlet mouth (25), the tangents of the opaque zones (37) and of the first transparent zones (38) cross with an angle different to zero the tangents of the colored zones (57) and of the second transparent zones (58).

5. Stage light fixture according to claim 4, wherein the angle formed by the tangents is comprised between about 60° and about 90°.

6. Stage light fixture according to claim 1, wherein the dimmer filter (26) comprises an opaque region (33), a first transparent region (34); the evanescent region (35) extending between the opaque region (33) and the first transparent region (34).

7. Stage light fixture according to claim 6, wherein the opaque zones (37) have an area substantially increasing along a first direction (E) from the transparent region (34) to the opaque region (33), while the transparent zones (38) have a section substantially decreasing along the same first direction (E).

8. Stage light fixture according to claim 1, wherein the color filter (43*a*, 43*b*, 43*c*) comprises a colored region (53), a second transparent region (54); the evanescent colored region (55) extending between the colored region (53) and the second transparent region (54).

9. Stage light fixture according to claim 8, wherein the colored zones (57) have an area substantially increasing along a second direction (F) from the transparent region (54) to the colored region (53), while the transparent zones (58) have a section substantially decreasing along the same second direction (F).

10. Stage light fixture according to claim 1, comprising a reflector (4) coupled to the light source (3); the light source (3) and the reflector (4) being designed and connected to each other to concentrate the rays of the beam substantially at a work point (PL) of the light beam; the light beam having a diameter lower than about 1 mm at the work point (PL).

11. Stage light fixture according to claim 10, comprising a final lens (5) arranged downstream of the color filter assembly (21) and of the dimmer filter (26) along the optical axis (B) and provided with a focal point (PF); the focal point (PF) being substantially coincident with the work point (PL).

12. Stage light fixture according to claim 1, wherein the light source (3) comprises a short arc lamp.

* * * * *